United States Patent [19]

Magnall et al.

[11] 4,115,991

[45] Sep. 26, 1978

[54] ASBESTOS PRODUCTS

[75] Inventors: Anthony N. Magnall, Haslingden; Philip H. Taylor, Rochdale; Fred Roberts, Blackpool, all of England

[73] Assignee: TBA Industrial Products Ltd., Manchester, England

[21] Appl. No.: 660,495

[22] Filed: Feb. 23, 1976

[30] Foreign Application Priority Data

Mar. 8, 1975 [GB] United Kingdom ..... 9746/75

[51] Int. Cl.[2] ..... D02G 3/20

[52] U.S. Cl. ..... 57/153; 57/164; 162/155; 264/103; 264/181; 264/183; 264/237

[58] Field of Search ..... 264/28, 103, 109, 178 R, 264/178 F, 180–181, 183, 232, 233–234, 237, DIG. 32; 57/164, 153; 162/155

[56] References Cited

U.S. PATENT DOCUMENTS

| | | | |
|---|---|---|---|
| 2,619,677 | 12/1952 | Ryan | 264/180 |
| 2,940,892 | 6/1960 | Feigley et al. | 162/155 |
| 2,972,221 | 2/1961 | Wilke et al. | 264/109 |
| 3,014,835 | 12/1961 | Feigley et al. | 264/86 |
| 3,453,818 | 7/1969 | Novak et al. | 57/164 |
| 3,475,894 | 11/1969 | Wilke et al. | 264/103 |
| 3,634,568 | 1/1972 | Donaldson et al. | 264/103 |
| 3,806,572 | 4/1974 | Trainor et al. | 264/103 |
| 3,943,220 | 3/1976 | Barnett et al. | 264/103 |

OTHER PUBLICATIONS

Handbook of Chemistry and Physics – 54 Edition – p. C506, "Physical Constants of Organic Compounds--Myristic Acid".

*Primary Examiner*—Jeffery R. Thurlow

*Attorney, Agent, or Firm*—Diller, Brown, Ramik & Wight

[57] ABSTRACT

Coherent strands are made from a dispersion of asbestos fibres in an aqueous soap solution containing up to 100 percent molar excess of fatty acid, by a process including the steps of forming a stream of dispersion and chilling the newly formed stream sufficiently to gel the dispersion.

19 Claims, 5 Drawing Figures

ASBESTOS PRODUCTS

The present invention relates to the production of shaped, coherent bodies from aqueous dispersions of chrysotile asbestos fibre and, more particularly to the production of textile filaments and yarns therefrom.

A number of methods of producing coherent strands from aqueous dispersions of asbestos have been described, for example, in British Patent specifications Nos. 824,446 and 1,129,815. In each case, the dispersing agent is a soap and the method includes a coagulation step comprising precipitation by reaction with an aqueous solution of a polyvalent metal salt or an acid after extruding or otherwise forming the dispersion into a stream. Although such strands have good mechanical properties and can readily be spun in the wet state using conventional textile machinery, the presence of the coagulant chemicals can give rise to serious practical problems. In this specification, the term "strand" will be used throughout, although it should be read to include a multiplicity of filaments unless stated to the contrary.

In the case of polyvalent metal salts the main problem is their corrosive effect on the processing machinery, but difficulties can also be experienced in extracting the residual organic material. If a solvent extraction system is used, a hydrolysis step must be included because the metal soaps themselves are almost totally insoluble in all common solvents; even then the metallic oxide residues can act as binders and give undesirably stiff and brittle products. If cleansing by the action of heat is preferred, the temperature must be high enough to decompose the soap as few, if any, metal soaps are sufficiently volatile to permit their removal intact. This usually results in a discoloured product and the recovery of the organic material in a form which is unsuitable for re-use.

Coagulation with acid does not have the latter disadvantage, but the corrosive effects are, if anything, worse and the strands are frequently too weak to spin satisfactorily.

The specification accompanying commonly assigned application Ser. No. 660,431, now abandoned, discloses a method of dispersing asbestos in an aqueous solution of a soap in the presence of up to a 100% molar excess of fatty acid, 'excess' in this context meaning over and above the amount of fatty acid present in, or used in making the soap. Dispersions made by this method exhibit excellent smoothness and homogeneity and can be used in prior art strandforming processes.

According to the present invention a process for the production of a coherent strand from a dispersion of asbestos in an aqueous soap solution containing up to 100 percent molar excess of fatty acid comprises forming a stream of said dispersion and chilling said newly formed stream sufficiently to gel the dispersion.

Strands made by such a process may be strong enough to handle without the use of any chemical coagulant treatment previously believed essential, provided that the chilling step is carried out with care. In practice, all fatty acid dispersions are not equally suitable for use in processes according to the invention. In general, dispersions made using fatty acids containing high proportions of saturated acids are preferable to those containing appreciable quantities of unsaturated ones. Ammonia-based soaps appear to be particularly satisfactory, though the reason for this is not fully understood.

Although chilling may be effected by, for example, extruding the dispersion through a cooled metal tube or into the cold vapour above a vessel containing liquid nitrogen or solid carbon dioxide, it is preferred that the dispersion be shaped, for example, by extrusion through a nozzle and then chilled by contact with cold water. This can be carried out using apparatus of the types described in U.K. Patents 824,446 or 1,129,815 or in our copending application Ser. No. 510,723, now abandoned replaced by continuation application Ser. No. 663,751, now abandoned in turn replaced by CIP application Ser. No. 744,440, now U.S. Pat. No. 4,070,816, but preferably it is achieved by extruding a stream of dispersion onto cold water flowing down an angled chute. The water is preferably soft and may be deionised or distilled.

The coherent strand so formed may be collected, for example, in a wire mesh basket, and then twisted into yarn while still wet although its stength may be somewhat marginal for this purpose. Preferably, strand collection is by means of an endless permeable belt which receives the strand and carries it through an apparatus for removing excess water, for example, one or more pairs of nip rollers, and then through a soap/fatty acid extraction and drying apparatus. For example, suitable apparatus has been described in our co-pending application Ser. No. 510,723. This is prior to winding and any subsequent twisting operation to form a yarn.

Unfortunately, however, it has been observed that heating the strand in drying apparatus shortly after formation, for example in an oven, tends to cause it to re-disperse, i.e. overlapping folds soften and fuse to one another, making it impossible to remove a coherent strand from the belt for further processing. This problem can be prevented by allowing the strand to stand for an extended period before heating, though this can entail a delay of from 8–12 hours in the processing and is most inconvenient in what is potentially a continuous process.

However, it has also been discovered that the need for a long standing period can be avoided by including a further step in the process and, according to this preferred aspect of the invention, the smooth passage of the strand down the angled chute is impeded by the inclusion of at least one discontinuity which disturbs the flow of the cold water. The introduction of at least one such discontinuity which causes the strand to be subjected to a rapid change in both direction and tension, appears to enhance the process of coagulation and to render the effect thereof appreciably more permanent.

Several kinds of discontinuity have been found to be effective, although it is not practicable to specify what will be satisfactory under all conditions of dispersion type, chute angle and flow rate. Examples of chutes and discontinuities which have been found satisfactory will be given later.

Although the reasons for the effect of a discontinuity on the newly gelled strand are not fully understood, it is though that it may involve one or more of the following (A) faster leaching of soap from the dispersion into the water, (B) more extensive hydrolysis of the soap, (C) greater loss of structural water by syneresis and (D) change of gel structure because of faster cooling, all of which might be expected to occur on disruption of the water flow.

The achievement of good yarn properties depends on the achievement of a high degree of alignment of fibres within the strand. This requires the application of shear to the dispersion whilst in the liquid state and may best be effected by continuously drawing the stream of dispersion from the point at which it leaves the nozzle to that at which it solidifies. Preferably this is achieved by causing the cold water to flow at a velocity greater than that of the dispersion flowing through the nozzle such that the viscous drag of the flowing water exerts a tractive force on the stream which serves to draw out the dispersion in the desired manner. Thus the strand forming rate (the length of strand produced in unit time at the base of the chute) is greater than the velocity of the stream of dispersion at the nozzle. The ratio of these velocities, usually termed the "draw ratio" should be as high as possible, subject to the limitation that the stream should not become so thin that it splits. Typically it is within the range 5:1 to 10:1, through higher ratios have been used successfully. As the strand forming rate depends principally on the velocity of the water stream, which in turn depends on the volumetric water flow and the angle of inclination of the chute, it follows that, to minimise the problem of excess water drainage after strand collection, the chute should be as steep as possible and the water flow as low as possible. Chute angles of from 15° to 80° to the horizontal can be used; the shape, size and number of the discontinuities will affect the optimum angle for any given circumstances. It may also be possible to use a chute which is substantially horizontal if the strand collection apparatus includes means for applying a positive tractive force to the strand.

Particularly preferred embodiments of the invention will now be described by way of example with reference to the accompanying drawings in which.

Figure 1:
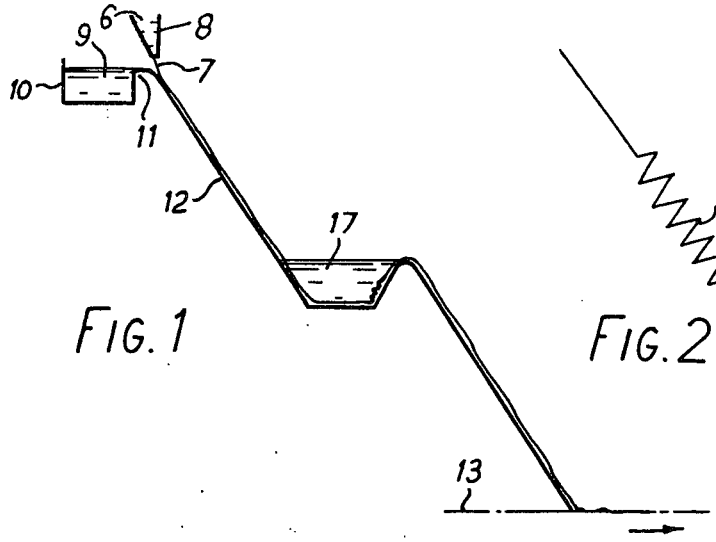
FIG. 1 is a diagrammatic side view of a strand forming apparatus.

In FIGS. 1–5 a fatty acid dispersion of asbestos 6 is discharged as a stream 7 through a nozzle 8 onto the surface of chilled water 9. As disclosed in the abovementioned copending application Ser. No. 660,431 the dispersion is formed in an aqueous solution of a soap in the presence of from 25–100% molar excess of fatty acid. The water flows from a header tank 10, over a weir 11 and down an angled chute 12, at the bottom of which the strand is collected on the surface of a wire mesh belt 13. The latter serves to separate the strand from the water, which is collected and re-circulated to the header tank 10, in this case via a filter 14 and a chilling unit 15 by a pump 16, these last three items being shown only in FIG. 5. In FIG. 1 the chute incorporates a discontinuity comprising a pool 17 through which the water and strand pass.

As this apparatus demands a fairly high volume flow of water in order to ensure that redispersion does not occur on heating and because such a high volume flow causes the deposition of the strand on the belt to be irregular, the chute arrangements of FIGS. 2–5 are preferred. In these figures, the discontinuities are shown on an exaggerated scale to illustrate the principle involved.

Figure 2:
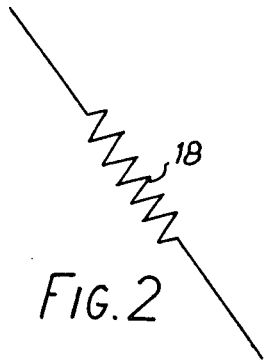
FIGS. 2 and 3 and 4 are diagrammatic side views of part of the strand forming apparatus of FIG. 1 and illustrate different chute configurations and FIG. 5 is a diagrammtic side view of a typical strand producing apparatus including ancilliary processing equipment.
Figure 3:
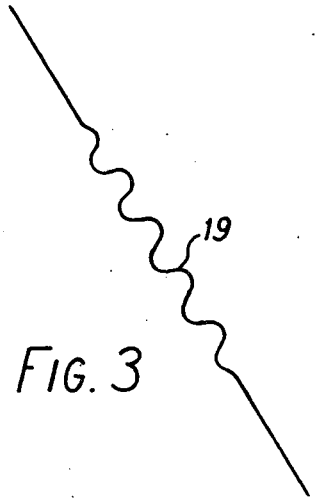
Figure 4:
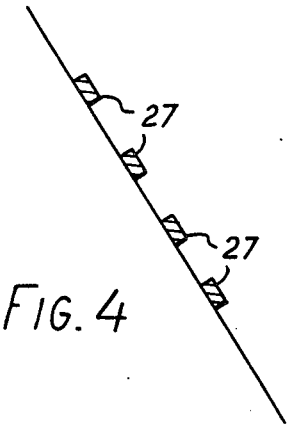

In FIG. 2, the chute incorporates a set of angular corrugations 18 and in FIG. 3 a set of sinusoidal corrugations 19. In FIG. 4 the chute has a series of rectangular bars 27 across it. In each case the effect is the same in that the strand is subjected to abrupt changes in both direction and tension.

Figure 5:
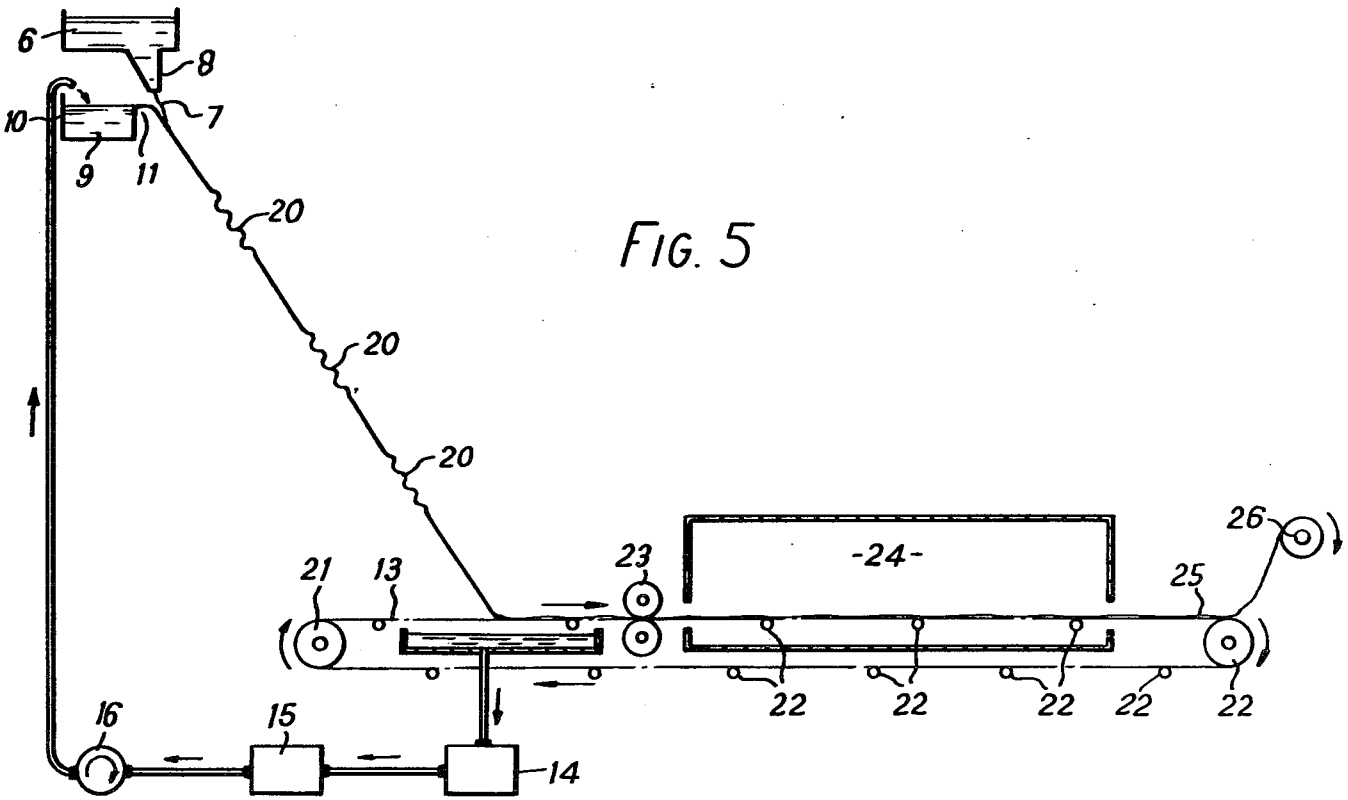

In FIG. 5 the chute has three spaced-apart sets of sinusoidal corrugations 20. This type of arrangement, in which plain and corrugated sections of the chute alternate, helps to minimise irregular bunching of the strand in the slower water flow over the corrugations, which can otherwise lead to thick patches in the strand assembly on the belt and to difficulties with drying and/or extraction of the residual organic material. The amplitude of the corrugations shown in this Figure is of the order of 9 mm with a wave length of about 32 mm and the angle of the chute is about 65° to the horizontal. The chute length is 4.2 meters and its width reduces from 250 mm at the top to 100 mm at the bottom by means of a tapering section between about 0.5 and 1.0 meters from the top; the corrugated sections are each some 600 mm long. At the bottom of the chute, the wire mesh belt 13 is of endless construction with a driving roller 21 at one end and support rollers 22 spaced apart along the length of each run. From the collection area at the bottom of the chute the strand is conveyed through a pair of nip rollers 23 and an oven 24 in which a substantially oxygen-free atmosphere is maintained by the injection of superheated steam and in which the strand is subjected to a temperature sufficient to vaporize the remaining water and at least the major part of the organic residue from the soap prior to withdrawing it from the belt at 25 and winding it onto a spool 26 suitable for transfer to a conventional textile twisting apparatus (not shown). A typical example of the use of this apparatus is as follows:

An aqueous dispersion of chrysotile asbestos, stabilised with ammonium myristate/myristic acid and containing approximately 4.7% by weight of asbestos fibre, was extruded through a slit nozzle approximately 100 mm wide by 1.0 mm high at a rate of 800 ml/min onto cold water having a flow rate of 7.5 l/min at an initial temperature of 4° C. The temperature of the dispersion was about 65° C. A 600 tex strand was collected on the belt (itself moving at 5 m/min) and at the winding station it was spooled at about 60 m/min. The strength of the wet strand after mangling, was about 10 Newtons; that at the winding station was about the same and yarn produced therefrom by twisting on a ring frame at 130 tpm had a tensile strength of about 40 Newtons and an extensibility of about 4%.

We claim:

1. A process for producing a coherent strand from a dispersion of asbestos in an aqueous soap solution containing a fatty acid in an amount up to a 100 percent molar excess over the fatty acid content of the soap comprising forming a stream of said dispersion, chilling said newly formed stream sufficiently to gel the dispersion and form a strand, said chilling step being effected by contacting the newly-formed stream with cold water, and treating the strand to prevent redispersion thereof under the action of heat.

2. A process according to claim 1 wherein the stream is formed by extruding the dispersion through a nozzle onto cold water flowing down an angled chute.

3. A process according to claim 2 wherein the newly gelled strand is subjected to variations in tension, said variations in tension being generated by causing the cold water to change direction relative to its overall direction of flow down the chute.

4. A process according to claim 3 wherein the water is caused to undergo a plurality of successive changes of direction.

5. A process to 2, wherein the cold water flows down the chute with a greater linear velocity than that of the dispersion flowing through the nozzle.

6. A process according to claim 5 wherein the ratio of the velocity of the cold water to that of the dispersion is in the range 5:1 to 20:1.

7. A process according to claim 1 including the further steps of separating the coherent strand from the chilling medium and subjecting it to a treatment effective to remove substantially all of the residual soap and fatty acid from the strand.

8. Coherent asbestos strands and yarns therefrom made by a process according to claim 1.

9. A method for producing a coherent strand from an aqueous dispersion of chrysotile asbestos fiber comprising the steps of:

(a) forming the dispersion by combining, in water, said asbestos with a fatty acid soap and a molar excess of the fatty acid of said soap, said excess not exceeding 100 percent;

(b) forming a stream of said dispersion;

(c) gelling said stream of dispersion by cooling to form a coherent strand;

(d) treating the coherent strand of step (c) substantially to prevent redispersion thereof under the action of heat; and (e) recovering said coherent strand.

10. A process as defined in claim 9 including the steps of:

(f) heating said coherent strand to dry same and extract residues of said soap and fatty acid therefrom; and (g) recovering said dried coherent strand.

11. A method as defined in claim 10 wherein step (f) is effected by subjecting said coherent strand to a substantially oxygen-free atmosphere which is maintained by injection of superheated steam.

12. A process for producing a coherent strand from an aqueous dispersion of chrysotile asbestos fiber comprising the steps of:

(a) forming the dispersion by combining, in water said asbestos fiber with a fatty acid soap and a 25 -100% molar excess of fatty acid;

(b) forming a stream of said dispersion and directing said stream along a downwardly inclined direction;

(c) gelling said stream of dispersion by flowing cold water therewith to form a coherent strand;

(d) treating said coherent strand by causing said water to change direction abruptly as said water and said strand pass in said downwardly inclined direction, thereby to form a coherent strand which is not redispersible under the action of heat;

(e) heating said coherent strand of step (d) to dry same and extract residues of said soap and fatty acid therefrom; and;

(f) recovering said dried coherent strand.

13. A method as defined in claim 9 wherein;

said soap is an ammonium myristate soap and said fatty acid is myristic acid.

14. A method as defined in claim 12 wherein:

said soap is an ammonium myristate soap and said fatty acid in myristic acid.

15. A method as defined as claim 14 wherein cold water of step (d) is at a temperature in the order of 4° C.

16. A method as defined in claim 9 wherein step (c) is effected by flowing cold water in contact with said stream.

17. A method as defined in claim 16 wherein said treatment of step (d) is provided by the inclusion of at least one discontinuity which disturbs the flow of said cold water, and causes said strand to be subjected to a rapid change in both direction and tension.

18. A method as defined in claim 17 wherein said stream of water flows at a faster rate than said stream of dispersion to provide a tractive force on said stream before it gels.

19. A method as defined in claim 18 wherein said rate of flow of said water to provide said tractive force is greater than the rate of flow of said stream of dispersion by a ratio in the order of 5:1 to 20:1.

* * * * *